US009904187B2

(12) United States Patent
Hongo et al.

(10) Patent No.: US 9,904,187 B2
(45) Date of Patent: Feb. 27, 2018

(54) CYLINDRICAL MEMBER USED IN ELECTROPHOTOGRAPHIC PHOTOCONDUCTOR, ELECTROPHOTOGRAPHIC PHOTOCONDUCTOR, IMAGE FORMING APPARATUS, PROCESS CARTRIDGE, AND METHOD FOR PRODUCING CYLINDRICAL MEMBER USED IN ELECTROPHOTOGRAPHIC PHOTOCONDUCTOR

(71) Applicant: FUJI XEROX CO., LTD., Tokyo (JP)

(72) Inventors: Kazuya Hongo, Kanagawa (JP); Masahiro Andoh, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/050,913

(22) Filed: Feb. 23, 2016

(65) Prior Publication Data

US 2017/0090311 A1 Mar. 30, 2017

(30) Foreign Application Priority Data

Sep. 25, 2015 (JP) ..... 2015-188583

(51) Int. Cl.

| | |
|---|---|
| ***G03G 5/10*** | (2006.01) |
| ***C23C 24/04*** | (2006.01) |
| ***G03G 5/05*** | (2006.01) |
| ***G03G 5/06*** | (2006.01) |
| ***G03G 21/18*** | (2006.01) |
| ***G03G 15/00*** | (2006.01) |

(52) U.S. Cl.

CPC ..... *G03G 5/102* (2013.01); *C23C 24/04* (2013.01); *G03G 5/056* (2013.01); *G03G 5/0696* (2013.01); *G03G 15/751* (2013.01); *G03G 21/18* (2013.01); *G03G 21/1814* (2013.01)

(58) Field of Classification Search

CPC ..... G03G 5/10; G03G 5/102

See application file for complete search history.

(56) References Cited

U.S. PATENT DOCUMENTS

| | | | | |
|---|---|---|---|---|
| 5,298,617 | A | 3/1994 | Nukada et al. | |
| 5,302,479 | A | 4/1994 | Daimon et al. | |
| 5,459,004 | A | 10/1995 | Daimon et al. | |
| 2011/0294053 | A1* | 12/2011 | Fujii | G03G 15/75 430/56 |
| 2014/0045109 | A1 | 2/2014 | Yamashita et al. | |
| 2014/0093816 | A1* | 4/2014 | Mizuta | G03G 5/043 430/56 |
| 2015/0050589 | A1* | 2/2015 | Fujii | G03G 5/0614 430/56 |
| 2015/0212436 | A1* | 7/2015 | Fujii | G03G 5/0517 430/56 |

FOREIGN PATENT DOCUMENTS

| | | | |
|---|---|---|---|
| EP | 0710893 | A1 | 5/1996 |
| JP | H04-189873 | A | 7/1992 |
| JP | H05-98181 | A | 4/1993 |
| JP | H05-140472 | A | 6/1993 |
| JP | H05-140473 | A | 6/1993 |
| JP | H05-263007 | A | 10/1993 |
| JP | H05-279591 | A | 10/1993 |
| JP | H08-176293 | A | 7/1996 |
| JP | H08-208820 | A | 8/1996 |
| JP | 2003-334631 | A | 11/2003 |
| JP | 2004-078147 | A | 3/2004 |
| JP | 2005-181992 | A | 7/2005 |
| JP | 2012-155282 | A | 8/2012 |
| JP | 2014-038135 | A | 2/2014 |
| JP | 2015-028107 | A | 2/2015 |

* cited by examiner

*Primary Examiner* — Hoa V Le

(74) *Attorney, Agent, or Firm* — Oliff PLC

(57) ABSTRACT

A cylindrical member used in an electrophotographic photoconductor, the cylindrical member includes an impact-pressed cylindrical body containing aluminum and a long-chain fatty acid ester based lubricant that is present on the outer surface of the impact-pressed cylindrical body in an amount of approximately not more than $5.0\times10^{-3}$ mg/cm$^2$.

3 Claims, 6 Drawing Sheets

CYLINDRICAL MEMBER USED IN ELECTROPHOTOGRAPHIC PHOTOCONDUCTOR, ELECTROPHOTOGRAPHIC PHOTOCONDUCTOR, IMAGE FORMING APPARATUS, PROCESS CARTRIDGE, AND METHOD FOR PRODUCING CYLINDRICAL MEMBER USED IN ELECTROPHOTOGRAPHIC PHOTOCONDUCTOR

CROSS-REFERENCE TO RELATED APPLICATIONS

This application is based on and claims priority under 35 USC 119 from Japanese Patent Application No. 2015-188583 filed Sep. 25, 2015.

BACKGROUND (i) Technical Field

The present invention relates to a cylindrical member used in an electrophotographic photoconductor, an electrophotographic photoconductor, an image forming apparatus, a process cartridge, and a method for producing the cylindrical member used in an electrophotographic photoconductor.

(ii) Related Art

Aluminum or aluminum alloys are used in cylindrical containers, such as drink containers and the cases of permanent markers, and in a variety of cylindrical aluminum members, such as supports of members used in image forming apparatuses, e.g., an electrophotographic photoconductor. An example of known techniques for processing aluminum or aluminum alloys in a cylindrical shape is impact pressing.

SUMMARY

According to an aspect of the invention, there is provided a cylindrical member used in an electrophotographic photoconductor, the cylindrical member including an impact-pressed cylindrical body containing aluminum and a long-chain fatty acid ester based lubricant that is present on the outer surface of the impact-pressed cylindrical body in an amount of approximately not more than $5.0\times10^{-3}$ mg/cm$^2$.

BRIEF DESCRIPTION OF THE DRAWINGS

Exemplary embodiments of the present invention will be described in detail based on the following figures, wherein.

DETAILED DESCRIPTION

Figure 1A:
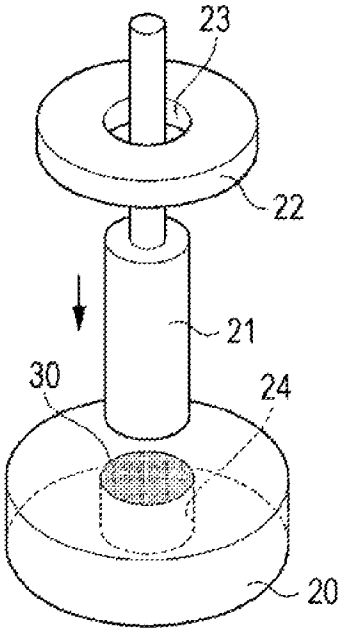
FIGS. 1A to 1C schematically illustrate part of a process for producing a cylindrical member used in an electrophotographic photoconductor according to a first exemplary embodiment (impact pressing)

Exemplary embodiments of the invention will now be described in detail.

Cylindrical Member Used in Electrophotographic Photoconductor

A cylindrical member used in an electrophotographic photoconductor according to a first exemplary embodiment (also simply referred to as "cylindrical member") includes an impact-pressed cylindrical body (also simply referred to as "cylindrical body") containing aluminum and a long-chain fatty acid ester based lubricant that is preset on the outer surface of the impact-pressed cylindrical body in an amount of approximately not more than $5.0\times10^{-3}$ mg/cm$^2$.

The impact-pressed cylindrical body herein refers to a cylindrical member formed by impact pressing.

The impact-pressed cylindrical body has a difference in the appearance from other cylindrical bodies formed of aluminum or aluminum alloys by other techniques (for example, plastic working, such as extrusion or drawing, and machining for further enhancing the accuracy of a cylindrical member formed by plastic working, such as cutting, grinding, deep drawing, or ironing). In particular, when a slug is impact-pressed, the peripheral part of the bottom of the slug extends; a change in color called shock line is caused at this extended part. Hence, belt-like faded-colored part having a width ranging from approximately 5 mm to 30 mm appears at part of the outer surface of the formed cylindrical body within the range from 20 mm to 100 mm from the bottom thereof. This appearance shows that the cylindrical body has been formed by impact pressing.

In typical formation of an aluminum-containing cylindrical body by impact pressing, a fatty acid metal salt, such as zinc stearate, is used as a lubricant in the impact pressing. This is because the fatty acid metal salt can properly reduce the damage that is easily caused on the outer surface of the cylindrical body in the impact pressing and also because it is cheap and easy to be prepared.

Fatty acid metal salts are, however, hard to be removed even through washing carried out after impact pressing and easy to remain as a washing residue on the outer surface of a cylindrical body. In the case where a cylindrical body of which a fatty acid metal salt as a lubricant is remaining on the surface is used as the support of an electrophotographic photoconductor (substrate as the layer underlying a photoconductive layer), defective coating may be caused, such as uneven application of a coating liquid (coating liquid used for forming a surface layer) to the surface of the cylindrical body or coating liquid repellency thereof, which results in a reduction in the accuracy in formation of the photoconductive layer.

In order to make it easier to remove fatty acid metal salts, a specific washing agent may be used, or an ultrasonic treatment or thermal treatment at high temperature may be carried out; however, such techniques cause the production process to be complexed with production costs being increased and are insufficient to completely remove the fatty acid metal salts.

From such a viewpoint, a cylindrical member used in an electrophotographic photoconductor and including an impact-pressed cylindrical body needs to be less likely to suffer from damage caused on the outer surface thereof and uneven application of a coating liquid to the outer surface or coating liquid repellency thereof.

In the cylindrical member according to the first exemplary embodiment, the surface of the impact-pressed cylindrical body contains a long-chain fatty acid ester based lubricant in the amount within the above-mentioned range, which reduces the damage caused on the outer surface thereof and uneven application of a coating liquid to the outer surface or coating liquid repellency thereof.

Such reductions in the damage and uneven application or coating liquid repellency are presumed to be given as follows.

In the cylindrical member according to the first exemplary embodiment, the surface of the impact-pressed cylindrical body contains a long-chain fatty acid ester based lubricant in the amount within the above-mentioned range, and this means that the long-chain fatty acid ester based lubricant is used as a lubricant in formation of the cylindrical body by impact pressing.

The long-chain fatty acid ester based lubricant is a lubricant that may give a good effect of lubrication in impact pressing and may reduce damage caused on the outer surface of the cylindrical body in the impact pressing. Use of the long-chain fatty acid ester based lubricant therefore eliminates use of another lubricant containing a fatty acid metal salt or enables a reduction in the amount of such another lubricant in impact pressing.

In addition, the long-chain fatty acid ester based lubricant may be easily removed through a simple washing process. The residual amount of the long-chain fatty acid ester based lubricant on the outer surface of the cylindrical body may be therefore easily reduced to the amount within the above-mentioned range without a complexed process such as use of a specific washing agent or an ultrasonic treatment or a thermal treatment at high temperature.

Thus, in the case where impact pressing is free from use of another lubricant containing a fatty acid metal salt, only the long-chain fatty acid ester based lubricant is used as a lubricant, and it may be therefore easily removed through a simple washing process, which reduces uneven application of a coating liquid to the surface of the cylindrical member (coating liquid used for forming a surface layer) and coating liquid repellency thereof. Even in the case where another lubricant containing a fatty acid metal salt is used in combination, the amount of such another lubricant may be small; accordingly, the residual amount thereof on the surface of the cylindrical body is relatively decreased, which reduces uneven application of a coating liquid to the surface of the cylindrical member and coating liquid repellency thereof.

Owing to the mechanism described above, the cylindrical member according to the first exemplary embodiment is less likely to suffer from damage caused on the outer surface of the cylindrical body and uneven application of a coating liquid to the outer surface of the cylindrical member and coating liquid repellency thereof. Thus, a photoconductive layer may be formed with high accuracy.

Residual Amount of Long-Chain Fatty Acid Ester Based Lubricant

In the first exemplary embodiment, the residual amount of the long-chain fatty acid ester based lubricant on the outer surface of the impact-pressed cylindrical body is approximately not more than $5.0\times10^{-3}$ mg/cm$^2$. Using the long-chain fatty acid ester based lubricant as a lubricant in impact pressing enables an easy reduction in the residual amount of the lubricant on the outer surface of the impact-pressed cylindrical body to the above-mentioned range. The residual amount of the long-chain fatty acid ester based lubricant within the above-mentioned range enables reductions in uneven application of a coating liquid to the outer surface of the cylindrical member and coating liquid repellency thereof.

The residual amount of the long-chain fatty acid ester based lubricant on the outer surface of the cylindrical body is preferably not more than $2.5\times10^{-3}$ mg/cm$^2$, and more preferably not more than $5.0\times10^{-4}$ mg/cm$^2$; the closer the amount is to 0 mg/cm$^2$, the more suitable.

The residual amount of the long-chain fatty acid ester based lubricant on the outer surface of the impact-pressed cylindrical body is measured as follows.

Principle of Measurement

A lubricant adhering to an object is extracted with an extractant (xylene), and the extract is irradiated with infrared light. The concentration of the lubricant detected near an absorption wavelength ranging from 3.4 μm to 3.5 μm, which is common to lubricants, is determined on the basis of a reference material. In general, the concentration of a lubricant is calculated as the amount of an adhering lubricant per unit area.

Equipment: Oil Concentration Meter OCMA 220 (manufactured by HORIBA, Ltd.)

Extractant: Xylene

Schematic Measurement

Amount of lubricant in extractant (xylene) (background value): A

Detected value of lubricant: B

Difference: C=B−A

Amount of extractant: D

Amount of lubricant: Q=C×D/1000

Area (internal and external surfaces) of substrate (cylindrical member): S

Concentration of oil per unit area of substrate: X=Q/S (mg/cm$^2$)

In the first exemplary embodiment, use of another lubricant containing a fatty acid metal salt as a lubricant in impact pressing can be eliminated, or the amount of such another lubricant, if any, can be reduced. The closer the residual amount of another lubricant on the outer surface of the impact-pressed cylindrical body is to 0 mg/cm$^2$, the more suitable; it is appropriate that the residual amount is 0 mg/cm$^2$, in other words, use of another lubricant as the lubricant in impact pressing is eliminated.

The residual amount of another lubricant on the outer surface of the impact-pressed cylindrical body can be measured as in the above-mentioned measurement of the residual amount of the long-chain fatty acid ester based lubricant.

Examples of another lubricant include, in addition to fatty acid metal salts, solid lubricants, such as zinc phosphate, zinc oxide, mica, calcium carbonate, molybdenum disulfide, graphite, and boron nitride, and oil-based lubricants in which a sulfur compound, a phosphate compound, an organic acid, a chlorine compound, or fat and oil has been added to a base oil such as a mineral oil.

Another lubricant that has been described above excludes a viscosity modifier which will be described later and which is used to adjust the viscosity of the long-chain fatty acid ester based lubricant.

The structure of the cylindrical member according to the first exemplary embodiment and a method for producing the same will now be described.

Structure of Cylindrical Member

The cylindrical member includes the impact-pressed cylindrical body (cylindrical body) and the long-chain fatty acid ester based lubricant that is present on the outer surface of the cylindrical body.

The cylindrical body contains aluminum and is suitably made of aluminum-containing metal (aluminum itself or aluminum alloy). The cylindrical body is conductive; in particular, it suitably has a volume resistivity of less than $10^{13}$ Ωcm.

Examples of the aluminum alloy used for forming the cylindrical body include aluminum alloys containing aluminum and Si, Fe, Cu, Mn, Mg, Cr, Zn, or Ti.

A suitable aluminum alloy used for forming the cylindrical body is a so-called 1000-series alloy; the aluminum content (mass basis) is desirably not less than 99.5%, and more desirably not less than 99.6% in view of processability, conductivity, and corrosion resistance.

Long-Chain Fatty Acid Ester Based Lubricant

The long-chain fatty acid ester is an ester compound in which the carboxyl group of a long-chain fatty acid (specifically, fatty acid having 12 or more carbon atoms) is ester-bonded to alcohol. The long-chain fatty acid ester based lubricant refers to lubricants of such long-chain fatty acid esters.

A fatty acid used as a material of the long-chain fatty acid ester preferably has 20 or more carbon atoms, and more preferably 30 or more carbon atoms. The upper limit of the number of carbon atoms is, but not limited to, preferably 100, and more preferably 70.

Examples thereof include stearic acid, palmitic acid, oleic acid, octylic acid, linolic acid, behenic acid, lignoceric acid, montanoic acid, melissic acid, and ricinoleic acid.

Among these, stearic acid, oleic acid, octylic acid, linolic acid, behenic acid, lignoceric acid, montanoic acid, melissic acid, and ricinoleic acid are suitable.

Examples of alcohol used as a material of the long-chain fatty acid ester include octanol, isopropyl alcohol, neopentyl polyol, myristyl alcohol, lauryl alcohol, decyl alcohol, oleyl alcohol, linoleyl alcohol, glycerine, and ethylene glycol.

Among these, octanol, isopropyl alcohol, neopentyl polyol, myristyl alcohol, lauryl alcohol, decyl alcohol, oleyl alcohol, and linoleyl alcohol are suitable.

Specific examples of the long-chain fatty acid ester based lubricant include saturated fatty acid esters of neopentyl polyol, octyl stearate, octyl palmitate, octyl oleate, lauryl linoleate, isopentyl montanate, lauryl behenate, neopentyl melissicate, decyl ricinoleate, and linoleyl lignocerate.

Among these, saturated fatty acid esters of neopentyl polyol, octyl stearate, octyl stearate, octyl palmitate, octyl oleate, lauryl linoleate, isopentyl montanate, and lauryl behenate are suitable.

Viscosity Modifier

In use of the long-chain fatty acid ester based lubricant as a lubricant in impact pressing, a viscosity modifier may be used in combination to adjust viscosity thereof.

Examples of the viscosity modifier include liquid hydrocarbon polymers, saccharides (e.g., carboxymethyl cellulose, pectin, guar gum, xanthan gum, and carrageenan), and propylene glycol.

In particular, liquid hydrocarbon polymers are suitable because they can be well removed by washing after impact pressing, well serve to adjust the viscosity of the long-chain fatty acid ester based lubricant, and be easily prepared. The liquid hydrocarbon polymers refer to hydrocarbon polymers that are in the form of liquid at normal temperature (20° C.).

Examples of the liquid hydrocarbon polymers include copolymers obtained through cationic polymerization of polybutene, polyisobutylene, and isobutene with normal butene; copolymers of isobutene with isopropylene; copolymers of isobutene with butadiene; copolymers of normal butene with styrene; and copolymers of normal butene with isopropylene.

Among these, the copolymers of polybutene, polyisobutylene, and isobutene with normal butene are suitable.

The liquid hydrocarbon polymer preferably has a number average molecular weight ranging from 100 to 3000, and more preferably 200 to 2000.

The number average molecular weight Mn of the liquid hydrocarbon polymer is measured by gel permeation chromatography (GPC) as follows. A solvent (tetrahydrofuran) is allowed to flow at 40° C. and a rate of 1.2 ml per minute, a sample solution in tetrahydrofuran at a concentration of 0.2 g/20 ml is put thereinto in a sample mass of 3 mg, and then measurement is carried out. In the measurement of the molecular weight of a sample, such conditions are employed that the molecular weight of the sample is encompassed in the range where the logarithm of the molecular weight of the standard curve prepared with several kinds of polystyrene standard samples and the count number exhibit linear relationship.

In the case where the molecular weight Mn of NBS 706 polystyrene standard sample is measured under the above-mentioned conditions and is $13.7\times10^4$, the reliability of results of the measurement is confirmed. The GPC columns to be used are TSK-GEL (manufactured by Tosoh Corporation). The solvent and measurement temperature are appropriately changed on the basis of the measurement conditions.

With regard to the viscosity of a mixture of the long-chain fatty acid ester based lubricant and the viscosity modifier (namely, the lubricant subjected to adjustment of viscosity), the kinematic viscosity thereof at 100° C. is preferably in the range of 0.1 $mm^2/s$ to 200 $mm^2/s$, more preferably 0.5 $mm^2/s$ to 150 $mm^2/s$, and further preferably 1.0 $mm^2/s$ to 100 $mm^2/s$ in order to produce a good effect of lubrication in impact pressing.

The kinematic viscosity of the long-chain fatty acid ester based lubricant at 100° C. is preferably in the range of 1 $mm^2/s$ to 50 $mm^2/s$, more preferably 3 $mm^2/s$ to 40 $mm^2/s$, and further preferably 5 $mm^2/s$ to 30 $mm^2/s$.

The kinematic viscosity of the viscosity modifier at 100° C. is preferably in the range of 0.1 $mm^2/s$ to 100 $mm^2/s$, more preferably 0.5 $mm^2/s$ to 80 $mm^2/s$, and further preferably 1.0 $mm^2/s$ to 60 $mm^2/s$.

The above-mentioned kinematic viscosity at 100° C. is measured in accordance with JIS K2283 "Crude petroleum and petroleum products-Determination of kinematic viscosity".

In the case where the long-chain fatty acid ester based lubricant and the viscosity modifier are mixed with each other to adjust the viscosity, the amount of the long-chain fatty acid ester based lubricant in the mixture thereof with the viscosity modifier is preferably from 5 mass % to 90 mass %, more preferably 10 mass % to 75 mass %, and further preferably 25 mass % to 70 mass %.

Method for Producing Cylindrical Member

A method for producing the cylindrical member according to the first exemplary embodiment will now be described. The cylindrical member according to the first exemplary embodiment is produced at least through the following process.

Preparing a Slug Containing Aluminum

Applying the long-chain fatty acid ester based lubricant on the surface of the slug Impact-pressing the lubricant-applied slug to form an impact-pressed cylindrical body Washing the outer surface of the impact-pressed cylindrical body with a washing agent Another procedure such as ironing may be additionally carried out after the impact pressing and before the washing.

Using the long-chain fatty acid ester based lubricant in the step of applying the lubricant and performing the washing step after the impact pressing enable the residual amount of the long-chain fatty acid ester based lubricant on the outer surface of the impact-pressed cylindrical body to be within the above-mentioned range.

Preparing Slug Containing Aluminum

A slug (material to be processed) is prepared. Examples of the slug include the above-mentioned aluminum and aluminum alloys that can be used for forming the cylindrical body. As illustrated in FIG. 1A, the slug to be prepared has a shape that is suitable for the hole of a die (female die) 20; for example, it is in the form of a slug 30.

The slug may be subjected to a pretreatment before being processed; for instance, a flat plate is compressed by being rolled with application of pressure and then punched into a slug, and the slug is annealed for homogenization.

Applying Lubricant

The long-chain fatty acid ester based lubricant is applied onto the surface of the prepared slug. The long-chain fatty acid ester based lubricant may be mixed with the above-mentioned viscosity modifier in advance for adjustment of the viscosity.

Another lubricant containing a fatty acid metal salt may be used in combination; however, the long-chain fatty acid ester based lubricant alone or only a mixture of the long-chain fatty acid ester based lubricant and the viscosity modifier is suitably used without another lubricant.

The lubricant may be applied onto the slug by any technique, and any of known techniques may be employed. Examples of such known techniques include spray coating, dip coating, bead coating, air knife coating, curtain coating, direct coating with a dispenser, coating with a dispenser having multiple probes, roller coating, and brush coating.

Impact Pressing

Figure 1B:
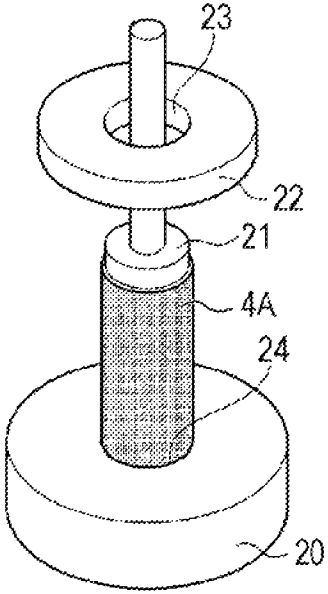
Figure 1C:
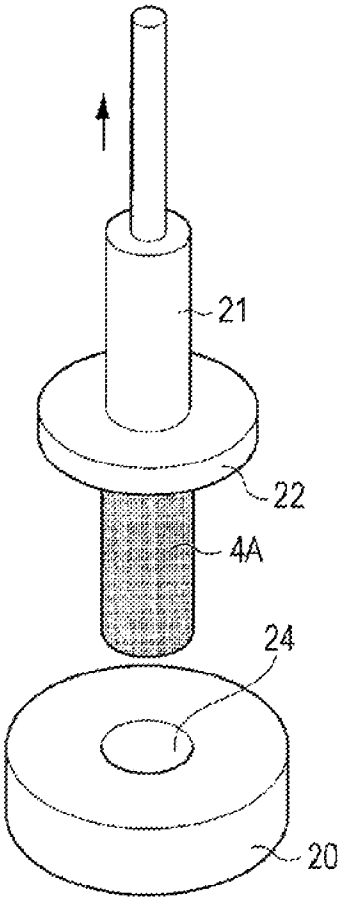

The impact pressing will now be described with reference to the drawings. FIGS. 1A to 1C illustrate an example of impact-pressing the slug containing aluminum in a cylindrical shape.

The slug 30 to which the lubricant has been applied is placed in a circular hole 24 formed in the die (female die) 20 as illustrated in FIG. 1A. The slug 30 placed on the die 20 is subsequently pressed with a columnar punch (male die) 21 as illustrated in FIG. 1B. Through these procedures, the slug 30 extends from the circular hole of the die 20 in a cylindrical shape so as to surround the punch 21. Then, as illustrated in FIG. 1C, the punch 21 is moved upward and allowed to travel through the central hole 23 of a stripper 22 to be pulled off, thereby producing a cylindrical product 4A.

Such impact pressing gives enhanced hardness resulting from work hardening and enables production of the aluminum-containing cylindrical product 4A having a small thickness and high hardness.

The thickness of the product 4A produced through the impact pressing is not particularly limited; however, the thickness is desirably from 0.4 mm to 0.8 mm, and more desirably from 0.4 mm to 0.6 mm because the thickness is decreased to be, for example, from 0.3 mm to 0.9 mm in the subsequent ironing while the hardness necessary for the cylindrical member used in an electrophotographic photoconductor is maintained.

Ironing

The product after the impact-pressing is optionally further subjected to ironing.

Figure 2B:
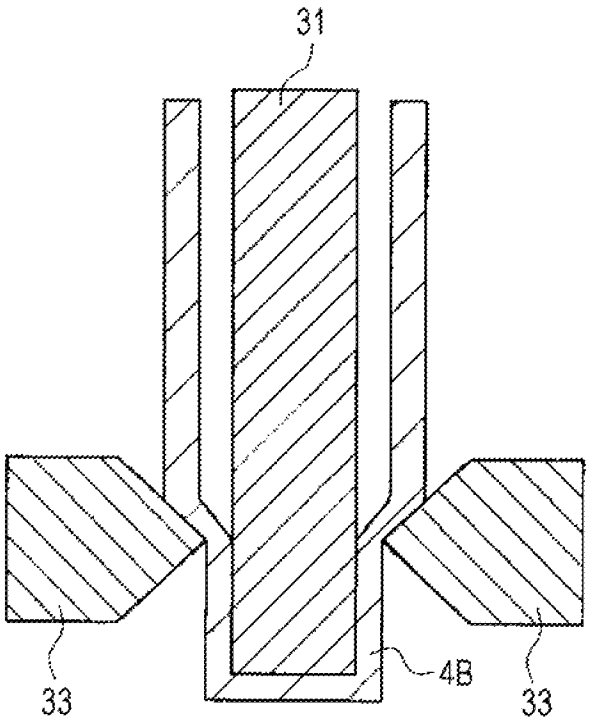
FIGS. 2A and 2B schematically illustrate other parts of the process for producing the cylindrical member used in an electrophotographic photoconductor according to the first exemplary embodiment (drawing and ironing)
Figure 2A:
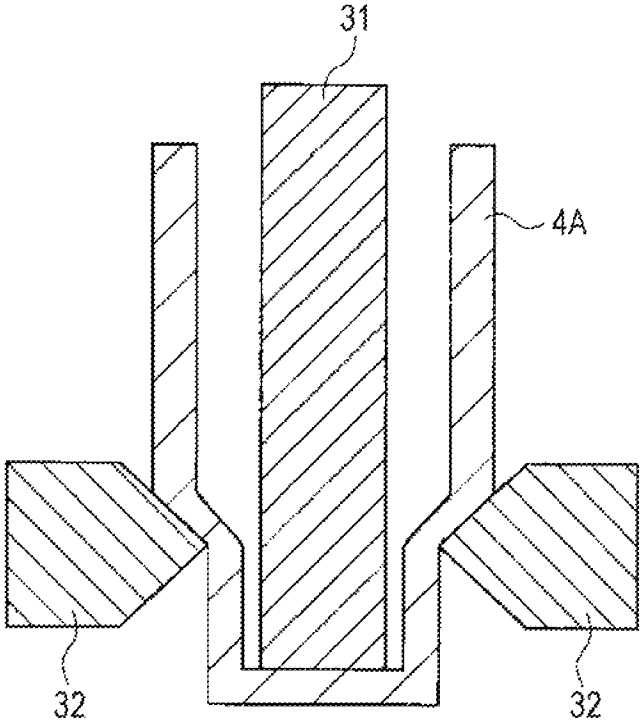

FIGS. 2A and 2B illustrate an example of ironing the outer surface of the cylindrical product produced through the impact pressing for the production of the cylindrical member.

A columnar punch 31 is inserted into the cylindrical product 4A produced through the impact pressing to press it into a die 32 as illustrated in FIG. 2A, thereby drawing the cylindrical product 4A in order to reduce the diameter thereof. Then, the resulting cylindrical product 4A is pressed into a die 33 having a smaller diameter for ironing as illustrated in FIG. 2B.

In the case where the ironing is performed, the drawing may not be carried out, or the ironing may have several steps. Furthermore, before the ironing, the cylindrical product 4A may be annealed to release the stress therein.

Any known oil that can be properly used for the ironing may be employed. A suitable example of such oil is a metal-free oil. In particular, materials called body-make (B/M) coolants or merely coolants are employed; specific examples thereof include water-soluble emulsions that are generally O/W emulsions and used at an emulsion concentration of approximately 10%, water-soluble materials, and water-soluble solutions.

A product 4B produced through the ironing desirably has a thickness ranging from 0.3 mm to 0.9 mm, and more desirably 0.4 mm to 0.6 mm because it enables a reduction in permanent deformation brought about by external impact while the hardness necessary for the cylindrical member used in an electrophotographic photoconductor is maintained.

The product 4A produced through the impact pressing is subjected to the ironing in this manner to produce a cylindrical member 4 having a small thickness and a light weight.

After the ironing, the cylindrical member 4 may be optionally annealed.

Such a cylindrical member 4 may be further subjected to cutting to remove the unnecessary part thereof.

Washing

The cylindrical member 4 after the impact pressing and optionally another step is subjected to the washing to wash the outer surface thereof with a washing agent.

The washing may be performed by any of known techniques; in the first exemplary embodiment, it is suitable that a simple washing technique that is free from a complexed procedure is employed because the long-chain fatty acid ester based lubricant, which is used as the lubricant in the impact pressing, can be easily removed by a simple washing technique.

Examples of a suitable washing technique include soak washing that involves a soak in a washing agent, flow washing that involves a soak in a flowing washing agent, ultrasonic washing, scrub washing, and shower washing.

Any of known washing agents can be used; in view of good removal of the long-chain fatty acid ester based lubricant, examples of the washing agent include hydrocarbon based washing agents, acids, alkalis, alkaline washing agents, and electrolytic alkaline water. Among these, hydrocarbon based washing agents are suitable.

Examples of the hydrocarbon based washing agents include straight-chain saturated aliphatic hydrocarbons such as pentane, hexane, heptane, octane, isooctane, nonane, decane, isodecane, undecane, and octadecane; straight-chain unsaturated hydrocarbons such as heptene, heptadiene, octene, dodecen, and dimers of isoprene; cyclic unsaturated hydrocarbons such as terpenes (e.g., α-pinene, β-pinene, limonene, and dipentene); and aromatic hydrocarbons such as toluene. These hydrocarbon based washing agents may be used alone or in combination. Examples of commercially available hydrocarbon based washing agents include normal paraffin series, Isosol series, and Isolan series (manufactured by Nippon Petro Chemicals Co., Ltd.); NS Clean series (manufactured by Nikko Petrochemical Co., Ltd.); Grade 1 kerosene defined by Japanese Industrial Standards; saturated hydrocarbon based solvents (Shellsol MC-311 manufactured by Shell Chemicals Japan Ltd.); and No. 0 SOLVENT L (manufactured by Nippon Oil Corporation).

Among these, normal paraffin series, Isosol series, and Isolan series (manufactured by Nippon Petro Chemicals Co., Ltd.); NS Clean series (manufactured by Nikko Petrochemical Co., Ltd.); saturated hydrocarbon based solvents (Shellsol MC-311 manufactured by Shell Chemicals Japan Ltd.); and No. 0 SOLVENT L (manufactured by Nippon Oil Corporation) are suitable.

The cylindrical member according to the first exemplary embodiment is produced in the manner described above.

An electrophotographic photoconductor in which the cylindrical member according to the first exemplary embodiment is used as a conductive support will now be described.

Electrophotographic Photoconductor

The electrophotographic photoconductor according to a second exemplary embodiment includes the cylindrical member (conductive support) according to the first exemplary embodiment and a photoconductive layer disposed so as to overlie the cylindrical member.

Figure 3:
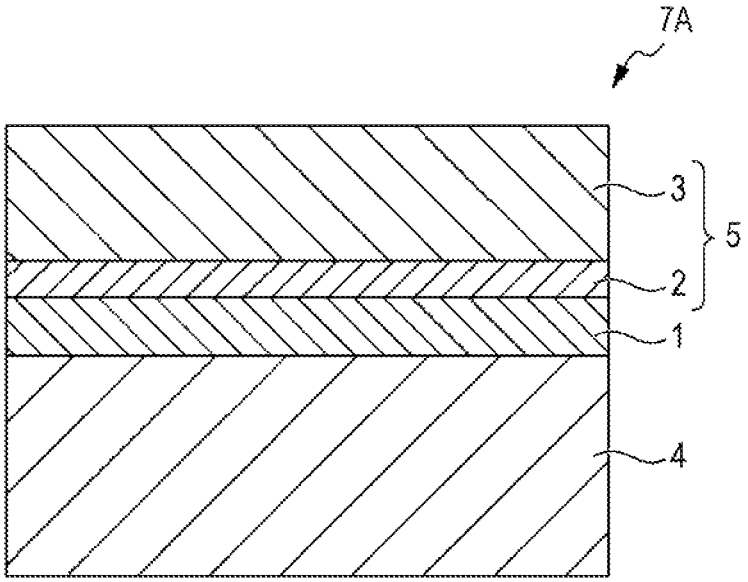
FIG. 3 is a partial cross-sectional view schematically illustrating an example of the structure of an electrophotographic photoconductor according to a second exemplary embodiment.

FIG. 3 is a schematic cross-sectional view illustrating an example of the layered structure of an electrophotographic photoconductor 7A according to the second exemplary embodiment. The electrophotographic photoconductor 7A illustrated in FIG. 3 includes a conductive support 4 and an undercoat layer 1, charge-generating layer 2, and charge-transporting layer 3 which are formed in sequence so as to overlie the conductive support 4; the charge-generating layer 2 and the charge-transporting layer 3 constitute a photoconductive layer 5.

FIGS. 4 to 7 are schematic cross-sectional views illustrating other examples of the layered structure of the electrophotographic photoconductor according to the second exemplary embodiment.

Figure 4:
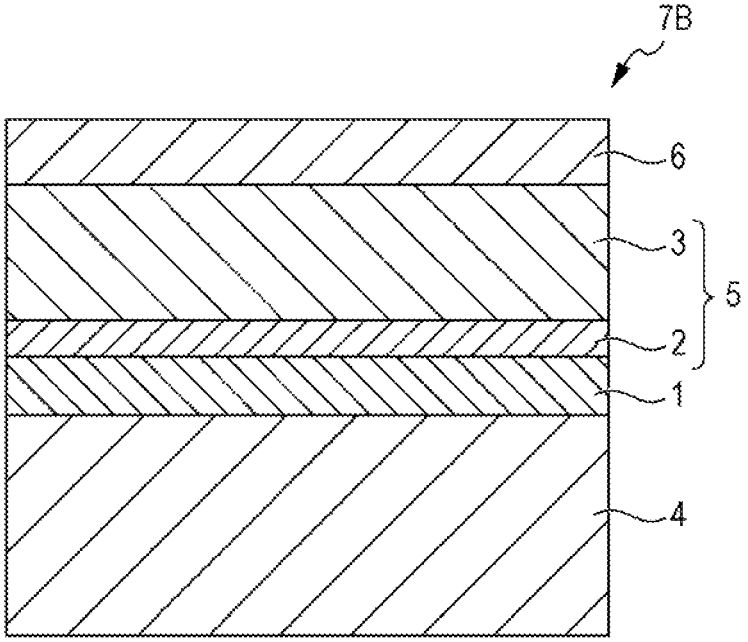
FIG. 4 is a partial cross-sectional view schematically illustrating another example of the structure of the electrophotographic photoconductor according to the second exemplary embodiment.
Figure 5:
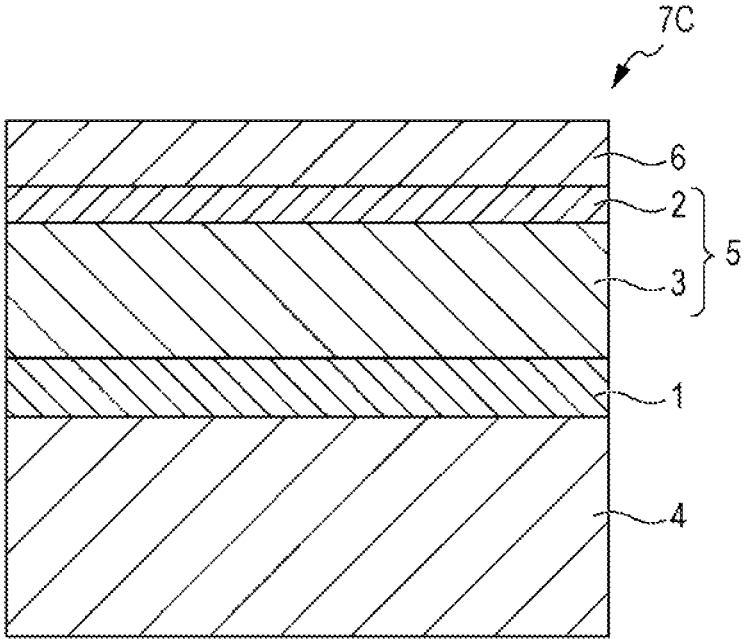
FIG. 5 is a partial cross-sectional view schematically illustrating another example of the structure of the electrophotographic photoconductor according to the second exemplary embodiment.

Electrophotographic photoconductors 7B and 7C illustrated in FIGS. 4 and 5, respectively, each have the photoconductor layer 5 in which the charge-generating layer 2 and the charge-transporting layer 3 are functionally separated as in the electrophotographic photoconductor 7A illustrated in FIG. 3; in addition, each of the electrophotographic photoconductors 7B and 7C includes a protection layer 6 as the outermost layer. The electrophotographic photoconductor 7B illustrated in FIG. 4 has a layered structure in which the undercoat layer 1, the charge-generating layer 2, the charge-transporting layer 3, and the protection layer 6 are disposed in sequence so as to overlie the conductive support 4. The electrophotographic photoconductor 7C illustrated in FIG. 5 has a layered structure in which the undercoat layer 1, the charge-transporting layer 3, the charge-generating layer 2, and the protection layer 6 are disposed in sequence so as to overlie the conductive support 4.

Figure 6:
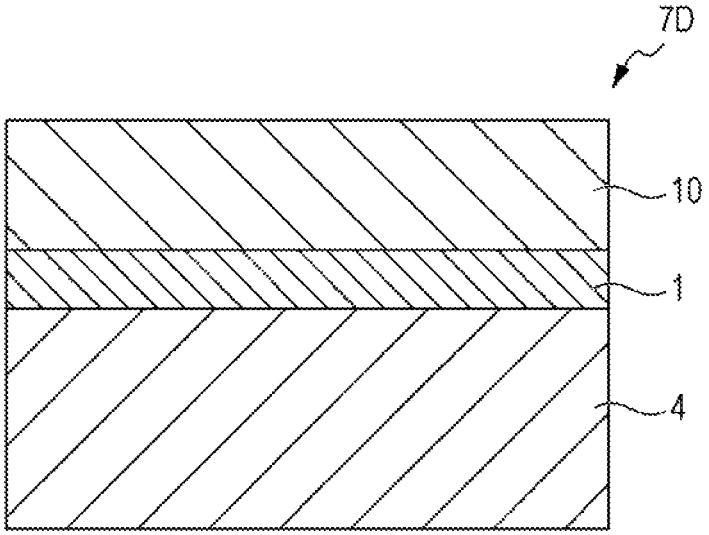
FIG. 6 is a partial cross-sectional view schematically illustrating another example of the structure of the electrophotographic photoconductor according to the second exemplary embodiment.
Figure 7:
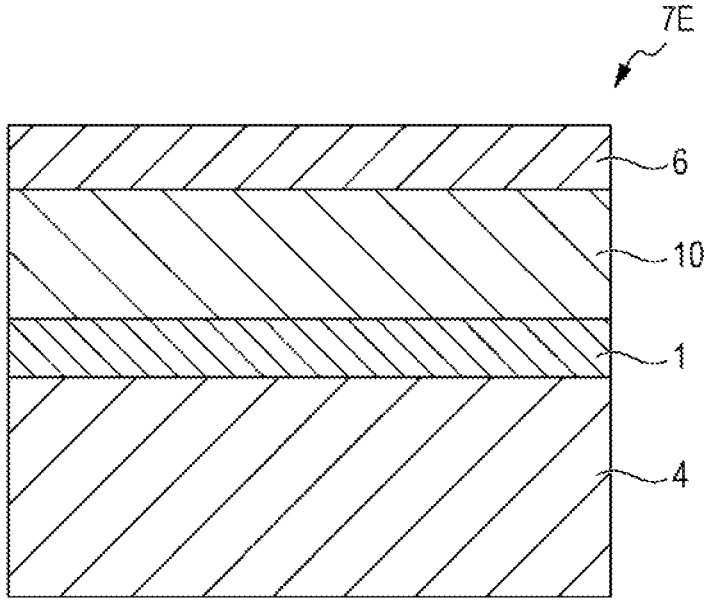
FIG. 7 is a partial cross-sectional view schematically illustrating another example of the structure of the electrophotographic photoconductor according to the second exemplary embodiment.

In electrophotographic photoconductors 7D and 7E illustrated in FIGS. 6 and 7, respectively, a single layer (single photoconductive layer 10) contains both a charge-generating material and a charge-transporting material and thus has an integrated function. The electrophotographic photoconductor 7D illustrated in FIG. 6 has a layered structure in which the undercoat layer 1 and the single photoconductive layer 10 are disposed in sequence so as to overlie the photoconductive support 4. The electrophotographic photoconductor 7E illustrated in FIG. 7 has a layered structure in which the undercoat layer 1, the single photoconductive layer 10, and the protection layer 6 are disposed in sequence so as to overlie the photoconductive support 4.

In each of the electrophotographic photoconductors 7A to 7E, the undercoat layer 1 is optionally not provided.

The structure of the electrophotographic photoconductor will now be described on the basis of the electrophotographic photoconductor 7B illustrated in FIG. 4. When the following description holds true for all of the electrophotographic photoconductors 7A to 7E in FIGS. 3 to 7, these electrophotographic photoconductors are referred to as "electrophotographic photoconductor 7" in some cases.

Conductive Substrate

The cylindrical member according to the first exemplary embodiment is used as a conductive substrate.

In the case where the electrophotographic photoconductor is used in a laser printer, the surface of the conductive substrate is suitably roughened to a center line average roughness Ra ranging from 0.04 μm to 0.5 μm in order to reduce interference fringes generated on radiation of laser light. The roughening for the reduction in interference fringes does not need to be performed when incoherent light is emitted from a light source; however, roughening the surface of the conductive substrate reduces generation of the defect thereof, which leads to prolonged product lifetime.

Examples of a technique for the roughening include wet honing in which an abrasive is suspended in water and then sprayed to the substrate, centerless grinding in which a rotating grindstone is pressed against the conductive substrate to continuously grind it, and anodic oxidation.

Another roughening technique may be used; for instance, conductive or semi-conductive powder is dispersed in resin, and the layer thereof is formed on the surface of the conductive substrate, and the particles dispersed in the layer serve for the roughening without directly roughening the surface of the conductive substrate.

In the roughening by anodic oxidation, a conductive substrate formed of metal (e.g., aluminum) serves as an anode for the anodic oxidation in an electrolyte solution, thereby forming an oxidation film on the surface of the conductive substrate. Examples of the electrolyte solution include a sulfuric acid solution and an oxalic acid solution. A porous anodic oxidation film formed by anodic oxidation is, however, chemically active in its original state; thus, it is easily contaminated and suffers from a great change in resistance depending on environment. Accordingly, the pores of the porous anodic oxidation film are suitably closed owing to volume expansion resulting from a hydration reaction in pressurized steam or in boiled water (metal salt such as nickel is optionally added) to turn the oxidation film to more stable hydrous oxide.

The thickness of the anodic oxidation film is, for example, suitably from 0.3 μm to 15 μm. At a thickness in such a range, barrier properties to injection are likely to be given, and an increase in the residual potential due to repeated use is likely to be reduced.

The conductive substrate is optionally subjected to a treatment with an acidic treatment liquid or a boehmite treatment.

An example of the treatment with an acidic treatment liquid is as follows. An acidic treatment liquid containing a phosphoric acid, a chromic acid, and a hydrofluoric acid is prepared. The amounts of the phosphoric acid, chromic acid, and hydrofluoric acid in the acidic treatment liquid are, for instance, in the range of 10 mass % to 11 mass %, 3 mass % to 5 mass %, and 0.5 mass % to 2 mass %, respectively; the total concentration of the whole acids are suitably from 13.5 mass % to 18 mass %. The treatment temperature is, for example, suitably in the range of 42° C. to 48° C. The thickness of the coating film is suitably from 0.3 μm to 15 μm.

The boehmite treatment, for instance, involves a soak in pure water at a temperature ranging from 90° C. to 100° C. for 5 to 60 minutes or contact with heated steam at a temperature ranging from 90° C. to 120° C. for 5 to 60 minutes. The thickness of the coating film is suitably from 0.1 μm to 5 μm. The coating film is optionally further subjected to an anodic oxidation treatment with an electrolyte solution that less dissolves the coating film, such as adipic acid, boric acid, borate, phosphate, phthalate, maleate, benzoate, tartrate, or citrate.

Undercoat Layer

An example of the undercoat layer is a layer containing inorganic particles and a binder resin.

Examples of the inorganic particles include inorganic particles having a powder resistance (volume resistivity) ranging from $10^2$ Ωcm to $10^{11}$ Ωcm.

Specific examples of the inorganic particles having such a resistance include metal oxide particles such as tin oxide particles, titanium oxide particles, zinc oxide particles, and zirconium oxide particles; in particular, zinc oxide particles are suitable.

The specific surface area of the inorganic particles, which is measured by a BET method, is, for example, suitably not less than 10 $m^2/g$.

The volume average particle diameter of the inorganic particles is, for instance, suitably from 50 nm to 2000 nm (preferably from 60 nm to 1000 nm).

The inorganic particle content is, for example, preferably in the range of 10 mass % to 80 mass %, and more preferably 40 mass % to 80 mass % relative to the binder resin content.

The inorganic particles are optionally subjected to a surface treatment. Two or more types of inorganic particles having difference in surface treatment or particle size may be used in combination.

Examples of a surface treatment agent to be used include a silane coupling agent, a titanate-based coupling agent, an aluminum-based coupling agent, and a surfactant. In particular, a silane coupling agent is preferred, and a silane coupling agent having an amino group is more preferred.

Examples of the silane coupling agent having an amino group include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

Two or more silane coupling agents may be used in combination; for example, the silane coupling agent having an amino group may be used in combination with another silane coupling agent. Examples of such another silane coupling agent include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

Any of known surface treatments with surface treatment agents may be employed, and either of a dry process and a wet process may be performed.

The amount of a surface treatment agent to be used is, for instance, suitably from 0.5 mass % to 10 mass % relative to the inorganic particle content.

The undercoat layer may contain an electron-accepting compound (acceptor compound) in addition to the inorganic particles in terms of enhancements in the long-term stability of electric properties and carrier-blocking properties.

Examples of the electron-accepting compound include electron-transporting materials, for instance, quinone compounds such as chloranil and bromoanil; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone compounds; thiophene compounds; and diphenoquinone compounds such as 3,3',5,5'-tetra-t-butyldiphenoquinone.

In particular, the electron-accepting compound is suitably a compound having an anthraquinone structure. Suitable examples of the compound having an anthraquinone structure include hydroxyanthraquinone compounds, aminoanthraquinone compounds, and aminohydroxyanthraquinone compounds. Specific examples thereof include anthraquinone, alizarin, quinizarin, anthrarufin, and purpurin.

The electron-accepting compound may be contained in the undercoat layer in a state in which it is dispersed along with the inorganic particles or in a state it is adhering to the surfaces of the inorganic particles.

The electron-accepting compound is allowed to adhere to the surfaces of the inorganic particles through, for example, a dry process or a wet process.

In a dry process, for instance, the inorganic particles are stirred with a mixer or another equipment having a large shear force, and the electron-accepting compound itself or a solution of the electron-accepting compound in an organic solvent is dropped or sprayed with dry air or nitrogen gas thereto under the stirring, thereby allowing the electron-accepting compound to adhere to the surfaces of the inorganic particles. The dropping or spraying of the electron-accepting compound may be performed at a temperature less than or equal to the boiling point of the solvent. After the dropping or spraying of the electron-accepting compound, the resulting product may be optionally baked at not less than 100° C. The baking may be performed at any temperature for any length of time provided that electrophotographic properties can be produced.

In a wet process, for example, the inorganic particles are dispersed in a solvent by a technique that involves use of stirring, ultrasonic, a sand mill, an attritor, or a ball mill; the electron-accepting compound is added thereto and then stirred or dispersed; and the solvent is subsequently removed, thereby allowing the electron-accepting compound to adhere to the surfaces of the inorganic particles. The solvent is removed, for instance, by filtration or distillation. After the removal of the solvent, the resulting product may be optionally baked at not less than 100° C. The baking may be performed at any temperature for any length of time provided that electrophotographic properties can be produced. In the wet process, the moisture content in the inorganic particles may be removed before the addition of the electron-accepting compound; examples of a technique for the removal include a technique in which the moisture is removed in a solvent under stirring and heating and a technique in which the moisture is removed through azeotropy with a solvent.

The electron-accepting compound may be allowed to adhere to the surfaces of the inorganic particles before or after the inorganic particles are subjected to the surface treatment with a surface treatment agent, and the process for the adhesion of the electron-accepting compound and the surface treatment may be performed at the same time.

The amount of the electron-accepting compound is, for example, suitably in the range of 0.01 mass % to 20 mass %, and preferably 0.01 mass % to 10 mass % relative to the inorganic particle content.

Examples of the binder resin used for forming the undercoat layer include known polymer compounds such as acetal resins (e.g., polyvinyl butyral), polyvinyl alcohol resins, polyvinyl acetal resins, casein resins, polyamide resins, cellulose resins, gelatine, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, urethane resins, alkyd resins, and epoxy resins; zirconium chelate compounds; titanium chelate compounds; aluminum chelate compounds; titanium alkoxide compounds; organic titanium compounds; and known materials such as silane coupling agents.

Other examples of the binder resin used for forming the undercoat layer include charge-transporting resins having charge-transporting groups and conductive resins (e.g., polyaniline).

The binder resin used for forming the undercoat layer is suitably insoluble in a solvent used to form the upper layer. In particular, suitable resins are thermosetting resins, such as urea resins, phenolic resins, phenol-formaldehyde resins, melamine resins, urethane resins, unsaturated polyester resins, alkyd resins, and epoxy resins, and resins produced through the reaction of a curing agent with at least one resin selected from the group consisting of polyamide resins, polyester resins, polyether resins, methacrylic resins, acrylic resins, polyvinyl alcohol resins, and polyvinyl acetal resins.

In the case where two or more of these binder resins are used in combination, the mixture ratio is appropriately determined.

The undercoat layer may contain a variety of additives to enhance electric properties, environmental stability, and image quality.

Examples of the additives include known materials such as electron-transporting pigments (e.g., condensed polycyclic pigments and azo pigments), zirconium chelate compounds, titanium chelate compounds, aluminum chelate compounds, titanium alkoxide compounds, organic titanium compounds, and silane coupling agents. A silane coupling agent is used for the surface treatment of the inorganic particles as described above; however, it may be further added, as an additive, to the undercoat layer.

Examples of the silane coupling agents as the additives include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

Examples of the zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetra-n-butyl titanate, butyl titanate dimer, tetra(2-ethylhexyl)titanate, titanium acetylacetonate, polytitanium acetylacetonate, titanium octylene glycolate, ammonium salts of titanium lactate, titanium lactate, ethyl esters of titanium lactate, titanium triethanol aminate, and polyhydroxytitanium stearate.

Examples of the aluminum chelate compounds include aluminum isopropylate, monobutoxyaluminum diisopropylate, aluminum butyrate, diethylacetoacetate aluminum diisopropylate, and aluminum tris(ethylacetoacetate).

These additives may be used alone or in the form of a mixture or polycondensate of multiple compounds.

The undercoat layer desirably has a Vickers hardness of not less than 35.

The surface roughness (ten-point average roughness) of the undercoat layer is desirably adjusted to be from ¼n (n is a refractive index of the upper layer) to ½ of the wavelength λ of laser light to be used for exposure in order to reduce Moire fringes.

The undercoat layer may contain, for example, resin particles in order to adjust the surface roughness. Examples of the resin particles include silicone resin particles and crosslinkable polymethyl methacrylate resin particles. The surface of the undercoat layer may be polished to adjust the surface roughness. Examples of a polishing technique include buff polishing, sandblasting, wet honing, and grinding.

The undercoat layer may be formed by any of known techniques; for instance, the above-mentioned components are added to a solvent to prepare a coating liquid used for forming the undercoat layer, the coating liquid is used to form a coating film, and the coating film is dried and optionally heated.

Examples of the solvent used in the preparation of the coating liquid used for forming the undercoat layer include known organic solvents such as alcohol solvents, aromatic hydrocarbon solvents, halogenated hydrocarbon solvents, ketone solvents, ketone alcohol solvents, ether solvents, and ester solvents.

Specific examples of such solvents include typical organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of a technique for dispersing the inorganic particles in the preparation of the coating liquid used for forming the undercoat layer include known techniques that involve use of a roll mill, a ball mill, a vibratory ball mill, an attritor, a sand mill, a colloid mill, or a paint shaker.

Examples of a technique for applying the coating liquid used for forming the undercoat layer onto the conductive substrate include typical techniques such as blade coating, wire bar coating, spray coating, dip coating, bead coating, air knife coating, and curtain coating.

The thickness of the undercoat layer is adjusted to be, for instance, preferably not less than 15 μm, and more preferably from 20 μm to 50 μm.

Intermediate Layer

Although not illustrated, an intermediate layer may be further provided between the undercoat layer and the photoconductive layer.

An example of the intermediate layer is a layer containing resin. Examples of the resin used for forming the intermediate layer include known polymer compounds such as acetal resins (e.g., polyvinyl butyral), polyvinyl alcohol resins, polyvinyl acetal resins, casein resins, polyamide resins, cellulose resins, gelatine, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer containing an organic metal compound. Examples of the organic metal compound used for forming the intermediate layer include organic metal compounds containing metal atoms of zirconium, titanium, aluminum, manganese, or silicon.

These compounds used for forming the intermediate layer may be used alone or in the form of a mixture or polycondensate of multiple compounds.

In particular, the intermediate layer is suitably a layer containing an organic metal compound that contains a zirconium atom or a silicon atom.

The intermediate layer may be formed by any of known techniques; for instance, the above-mentioned components are added to a solvent to prepare a coating liquid used for forming the intermediate layer, the coating liquid is used to form a coating film, and the coating film is dried and optionally heated.

Examples of a technique for applying the coating liquid used for forming the intermediate layer include typical techniques such as dip coating, push-up coating, wire bar coating, spray coating, blade coating, knife coating, and curtain coating.

The thickness of the intermediate layer is suitably adjusted to be, for instance, from 0.1 μm to 3 μm. The intermediate layer may serve as the undercoat layer.

Charge-Generating Layer

An example of the charge-generating layer is a layer containing a charge-generating material and a binder resin. The charge-generating layer may be a deposited layer of a charge-generating material. The deposited layer of a charge-generating material is suitable for the case in which an incoherent light source such as a light emitting diode (LED) or an organic electro-luminescence (EL) image array is used.

Examples of the charge-generating material include azo pigments such as bisazo pigments and trisazo pigments; fused ring aromatic pigments such as dibromoanthanthrone; perylene pigments; pyrrolopyrrole pigments; phthalocyanine pigments; zinc oxide; and trigonal selenium.

In particular, suitable charge-generating materials to enable exposure to laser light having a wavelength that is in a near infrared region are metal phthalocyanine pigments and metal-free phthalocyanine pigments. Specific examples thereof include hydroxygallium phthalocyanine disclosed in Japanese Unexamined Patent Application Publication Nos. 5-263007 and 5-279591, chlorogallium phthalocyanine disclosed in Japanese Unexamined Patent Application Publication No. 5-98181, dichlorotin phthalocyanine disclosed in Japanese Unexamined Patent Application Publication Nos. 5-140472 and 5-140473, and titanyl phthalocyanine disclosed in Japanese Unexamined Patent Application Publication No. 4-189873.

Suitable charge-generating materials to enable exposure to laser light having a wavelength that is in a near ultraviolet region are fused ring aromatic pigments such as dibromoanthanthrone, thioindigo pigments, porphyrazine compounds, zinc oxide, trigonal selenium, and bisazo pigments disclosed in Japanese Unexamined Patent Application Publication Nos. 2004-78147 and 2005-181992.

The above-mentioned charge-generating materials may be used also in the case where an incoherent light source such as an LED or organic EL image array having a central emission wavelength ranging from 450 nm to 780 nm is used; however, when the photoconductive layer has a thickness of not more than 20 μm in terms of resolution, the field intensity in the photoconductive layer becomes high, which easily results in a decrease in the degree of charging due to electric charges injected from the substrate, namely the occurrence of image defects called black spots. This phenomenon is more likely to be caused in the case of using charge-generating materials that are p-type semiconductors and that easily generate dark current, such as trigonal selenium and a phthalocyanine pigment.

Use of charge-generating materials that are n-type semiconductors, such as fused ring aromatic pigments, perylene pigments, and azo pigments, is less likely to generate dark current and enables a reduction in the occurrence of image defects called black spots even at the reduced thickness of the photoconductive layer. Examples of such n-type charge-generating materials include, but are not limited to, compounds (CG-1) to (CG-27) disclosed in the paragraphs [0288] to [0291] of Japanese Unexamined Patent Application Publication No. 2012-155282.

In order to distinguish an n-type charge-generating material, a time-of-flight technique that has been generally employed is used to analyze the polarity of flowing photoelectric current, and a material in which electrons are likely to flow as carriers rather than holes is determined as an n-type charge-generating material.

The binder resin used for forming the charge-generating layer is selected from a variety of insulating resins and may be selected from organic photoconductive polymers such as poly-N-vinylcarbazole, polyvinyl anthracene, polyvinyl pyrene, and polysilane.

Examples of the binder resin include polyvinyl butyral resins, polyarylate resins (such as a polycondensate made from a bisphenol and an aromatic divalent carboxylic acid), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. The term "insulating" herein refers to a volume resistivity of not less than $10^{13}$ Ωm.

These binder resins may be used alone or in combination.

The mixture ratio of the charge-generating material to the binder resin is suitably from 10:1 to 1:10 on a mass basis.

The charge-generating layer may further contain a known additive.

The charge-generating layer may be formed by any of known techniques; for instance, the above-mentioned components are added to a solvent to prepare a coating liquid used for forming the charge-generating layer, the coating liquid is used to form a coating film, and the coating film is dried and optionally heated. The charge-generating layer may be formed by depositing the charge-generating material. Such formation of the charge-generating layer by deposition is suitable particularly in the case of using a fused ring aromatic pigment or a perylene pigment as the charge-generating material.

Examples of the solvent used in the preparation of the coating liquid used for forming the charge-generating layer include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents may be used alone or in combination.

Particles (e.g., charge-generating material) are, for example, dispersed in the coating liquid used for forming the charge-generating layer with a disperser involving use of media, such as a ball mill, a vibratory ball mill, an attritor, a sand mill, or horizontal sand mill, or with a media-free disperser such as a stirrer, a ultrasonic disperser, a roll mill, and a high-pressure homogenizer. Examples of the high-pressure homogenizer include an impact-type homogenizer in which a highly pressurized dispersion liquid is allowed to collide with another liquid or a wall for dispersion and a through-type homogenizer in which a highly pressurized dispersion liquid is allowed to flow through a fine flow channel for dispersion.

In this dispersion procedure, it is effective that the average particle size of the charge-generating material used in the coating liquid for forming the charge-generating layer is not more than 0.5 μm, preferably not more than 0.3 μm, and more preferably not more than 0.15 μm.

Examples of a technique for applying the coating liquid used for forming the charge-generating layer onto the undercoat layer (or intermediate layer) include typical techniques such as blade coating, wire bar coating, spray coating, dip coating, bead coating, air knife coating, and curtain coating.

The thickness of the charge-generating layer is, for example, adjusted to be suitably from 0.1 μm to 5.0 μm, and preferably 0.2 μm to 2.0 μm.

Charge-Transporting Layer

An example of the charge-transporting layer is a layer containing a charge-transporting material and a binder resin. The charge-transporting layer may be a layer containing a charge-transporting polymeric material.

Examples of the charge-transporting material include electron-transporting compounds, e.g., quinone compounds such as p-benzoquinone, chloranil, bromanil, and anthraquinone; tetracyanoquinodimethane compounds; fluorenone compounds such as 2,4,7-trinitrofluorenone; xanthone compounds; benzophenone compounds; cyanovinyl compounds; and ethylene compounds. Other examples of the charge-transporting material include hole-transporting compounds such as triarylamine compounds, benzidine compounds, arylalkane compounds, aryl-substituted ethylene compounds, stilbene compounds, anthracene compounds, and hydrazone compounds. These charge-transporting materials are used alone or in combination but not limited thereto.

The charge-transporting material is suitably any of triarylamine derivatives represented by Structural Formula (a-1) or any of benzidine derivatives represented by Structural Formula (a-2) in terms of charge mobility.

(a-1)

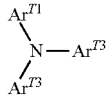

In Structural Formula (a-1), $Ar^{T1}$, $Ar^{T2}$, and $Ar^{T3}$ each independently represent a substituted or unsubstituted aryl group, $—C_6—H_4—C(R^{T4})=C(R^{T5})(R^{T6})$, or $—C_6—H_4—CH=CH—CH=C(R^{T7})(R^{T8})$. $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Examples of the substituent of each of these groups include a halogen atom, an alkyl group having 1 to 5 carbon atoms, and alkoxy group having 1 to 5 carbon atoms. Another example of the substituent is a substituted amino group that is substituted with an alkyl group having 1 to 3 carbon atoms.

(a-2)

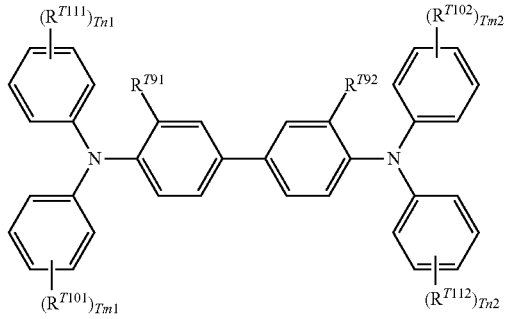

In Structural Formula (a-2), $R^{T91}$ and $R^{T92}$ each independently represent a hydrogen atom, a halogen atom, an alkyl group having 1 to 5 carbon atoms, or an alkoxy group having 1 to 5 carbon atoms. $R^{T101}$, $R^{T102}$, $R^{T111}$, and $R^{T112}$ each independently represent a halogen atom, an alkyl group having 1 to 5 carbon atoms, an alkoxy group having 1 to 5 carbon atoms, an amino group substituted with an alkyl group having 1 or 2 carbon atoms, a substituted or unsubstituted aryl group, $—C(R^{T12})=C(R^{T13})(R^{T14})$, or $—CH=CH—CH=C(R^{T15})(R^{T16})$; $R^{T12}$, $R^{T13}$, $R^{T14}$, $R^{T15}$, and $R^{T16}$ each independently represent a hydrogen atom, a substituted or unsubstituted alkyl group, or a substituted or unsubstituted aryl group. Tm1, Tm2, Tn1, and Tn2 each independently represent an integer from 0 to 2.

Examples of the substituent of each of these groups include a halogen atom, an alkyl group having 1 to 5 carbon atoms, and alkoxy group having 1 to 5 carbon atoms. Another example of the substituent is a substituted amino group that is substituted with an alkyl group having 1 to 3 carbon atoms.

Among the triarylamine derivatives represented by Structural Formula (a-1) and the benzidine derivatives represented by Structural Formula (a-2), a triarylamine derivative having a part "$—C_6H_4—CH=CH—CH=C(R^{T7})(R^{T8})$," and a benzidine derivative having a part "$—CH=CH—CH=C(R^{T15})(R^{T16})$" are suitable in terms of charge mobility.

Examples of the charge-transporting polymeric material include known materials having a charge transportability, such as poly-N-vinylcarbazole and polysilane. In particular, charge-transporting polymeric materials involving polyester, which are disclosed in Japanese Unexamined Patent Application Publication Nos. 8-176293 and 8-208820, are suitable. The charge-transporting polymeric material may be used alone or in combination with a binder resin.

Examples of the binder resin used in the charge-transporting layer include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinylcarbazole, and polysilane. Among these, polycarbonate resins and polyarylate resins are suitably used as the binder resin. These binder resins are used alone or in combination.

The mixing ratio of the charge-transporting material to the binder resin is suitably from 10:1 to 1:5 on a mass basis.

The charge-transporting layer may further contain a known additive.

The charge-transporting layer may be formed by any of known techniques; for instance, the above-mentioned components are added to a solvent to prepare a coating liquid used for forming the charge-transporting layer, the coating liquid is used to form a coating film, and the coating film is dried and optionally heated.

Examples of the solvent used in the preparation of the coating liquid used for forming the charge-transporting layer include typical organic solvents, e.g., aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic or straight-chain ethers such as tetrahydrofuran and ethyl ether. These solvents are used alone or in combination.

Examples of a technique for applying the coating liquid used for forming the charge-transporting layer onto the charge-generating layer include typical techniques such as blade coating, wire bar coating, spray coating, dip coating, bead coating, air knife coating, and curtain coating.

The thickness of the charge-transporting layer is, for instance, adjusted to be preferably from 5 μm to 50 μm, and more preferably 10 μm to 30 μm.

Protection Layer

The protection layer is optionally formed on the photoconductive layer. The protection layer is formed, for instance, in order to prevent the photoconductive layer from being chemically changed in the charging and to improve the mechanical strength of the photoconductive layer.

Hence, the protection layer is properly a layer of a cured film (crosslinked film). Examples of such a layer include the following layers (1) and (2).

(1) Layer of a cured film made of a composition that contains a reactive-group-containing charge-transporting material of which one molecule has both a reactive group and a charge-transporting skeleton (in other words, layer containing a polymer or crosslinked product of the reactive-group-containing charge-transporting material)

(2) Layer of a cured film made of a composition that contains a nonreactive charge-transporting material and a reactive-group-containing non-charge-transporting material that does not have a charge-transporting skeleton but has a reactive group (in other words, layer containing polymers or crosslinked products of the nonreactive charge-transporting material and reactive-group-containing non-charge-transporting material)

Examples of the reactive group of the reactive-group-containing charge-transporting material include known reactive groups such as a chain polymerizable group, an epoxy group, —OH, —OR (where R represents an alkyl group), $—NH_2$, —SH, —COOH, and $—SiR^{Q1}{}_{3-Qn}(OR^{Q2})_{Qn}$ (where $R^{Q1}$ represents a hydrogen atom, an alkyl group, or a substituted or unsubstituted aryl group; $R^{Q2}$ represents a hydrogen atom, an alkyl group, or a trialkylsilyl group; and Qn represents an integer from 1 to 3).

Any chain polymerizable group may be employed provided that it is a functional group that enables a radical polymerization; for example, a functional group at least having a group with a carbon double bond may be employed. Specific examples thereof include groups containing at least one selected from a vinyl group, a vinyl ether group, a vinyl thioether group, a styryl group (vinylphenyl group), an acryloyl group, a methacryloyl group, and derivatives thereof. Among these, suitable chain polymerizable groups are groups containing at least one selected from a vinyl group, a styryl group (vinylphenyl group), an acryloyl group, a methacryloyl group, and derivatives thereof because they have excellent reactivity.

The charge-transporting skeleton of the reactive-group-containing charge-transporting material is not particularly limited provided that it is a known structure in the field of electrophotographic photoconductors. Examples of such a structure include skeletons that are derived from nitrogen-containing hole-transporting compounds, such as triarylamine compounds, benzidine compounds, and hydrazone compounds, and that are conjugated with a nitrogen atom. In particular, triarylamine skeletons are suitable.

The reactive-group-containing charge-transporting material having both a reactive group and a charge-transporting skeleton, the nonreactive charge-transporting material, and the reactive-group-containing non-charge transporting material may be selected from known materials.

The protection layer may further contain a known additive.

The protection layer may be formed by any of known techniques; for instance, the above-mentioned components are added to a solvent to prepare a coating liquid used for forming the protection layer, the coating liquid is used to form a coating film, and the coating film is dried and optionally heated for curing.

Examples of the solvent used in the preparation of the coating liquid used for forming the protection layer include aromatic hydrocarbon solvents such as toluene and xylene; ketone solvents such as methyl ethyl ketone, methyl isobutyl ketone, and cyclohexanone; ester solvents such as ethyl acetate and butyl acetate; ether solvents such as tetrahydrofuran and dioxane; cellosolve solvents such as ethylene glycol monomethyl ether; and alcohol solvents such as isopropyl alcohol and butanol. These solvents are used alone or in combination.

The coating liquid used for forming the protection layer may be a solventless coating liquid.

Examples of a technique for applying the coating liquid used for forming the protection layer onto the photoconductive layer (e.g., charge-transporting layer) include typical techniques such as dip coating, push-up coating, wire bar coating, spray coating, blade coating, knife coating, and curtain coating.

The thickness of the protection layer is, for instance, adjusted to be preferably from 1 μm to 20 μm, and more preferably 2 μm to 10 μm.

Single Photoconductive Layer

The single photoconductive layer (charge-generating/charge-transporting layer) is, for example, a layer containing a charge-generating material, a charge-transporting material, and optionally a binder resin and another known additive. These materials are the same as those described as the materials used for forming the charge-generating layer and the charge-transporting layer.

The amount of the charge-generating material contained in the single photoconductive layer is suitably from 10 mass % to 85 mass %, and preferably 20 mass % to 50 mass % relative to the total solid content. The amount of the charge-transporting material contained in the single photoconductive layer is suitably from 5 mass % to 50 mass % relative to the total solid content.

The single photoconductive layer is formed by the same technique as those for forming the charge-generating layer and the charge-transporting layer.

The thickness of the single photoconductive layer is, for instance, suitably from 5 μm to 50 μm, and preferably from 10 μm to 40 μm.

Image Forming Apparatus (and Process Cartridge)

An image forming apparatus according to a third exemplary embodiment includes an electrophotographic photoconductor, a charging unit that serves to charge the surface of the electrophotographic photoconductor, an electrostatic latent image forming unit that serves to form an electrostatic latent image on the surface of the charged electrophotographic photoconductor, a developing unit that serves to develop the electrostatic latent image on the surface of the electrophotographic photoconductor with a developer containing toner to form a toner image, and a transfer unit that serves to transfer the toner image to the surface of a recording medium. The electrophotographic photoconductor is the electrophotographic photoconductor according to the second exemplary embodiment.

The image forming apparatus according to the third exemplary embodiment may be any of the following known image forming apparatuses: an apparatus which has a fixing unit that serves to fix the toner image transferred to the surface of a recording medium, a direct-transfer-type apparatus in which the toner image formed on the surface of the electrophotographic photoconductor is directly transferred to a recording medium, an intermediate-transfer-type apparatus in which the toner image formed on the surface of the electrophotographic photoconductor is subjected to first transfer to the surface of an intermediate transfer body and in which the toner image transferred to the surface of the intermediate transfer body is then subjected to second transfer to the surface of a recording medium, an apparatus which has a cleaning unit that serves to clean the surface of the electrophotographic photoconductor after the transfer of a toner image and before the charging of the electrophotographic photoconductor, an apparatus which has an erasing unit that serves to radiate light to the surface of the electrophotographic photoconductor for removal of charges after the transfer of a toner image and before the charging of the electrophotographic photoconductor, and an apparatus which has an electrophotographic photoconductor heating unit that serves to heat the electrophotographic photoconductor to decrease the relative temperature.

In the intermediate-transfer-type apparatus, the transfer unit, for example, includes an intermediate transfer body of which a toner image is to be transferred to the surface, a first transfer unit which serves for first transfer of the toner image formed on the surface of the electrophotographic photoconductor to the surface of the intermediate transfer body, and a second transfer unit which serves for second transfer of the toner image transferred to the surface of the intermediate transfer body to the surface of a recording medium.

The image forming apparatus according to the third exemplary embodiment may be either of a dry development type and a wet development type (development with a liquid developer is performed).

In the structure of the image forming apparatus according to the third exemplary embodiment, for instance, the part that includes the electrophotographic photoconductor may be in the form of a cartridge that is removably attached to the image forming apparatus (process cartridge). A suitable example of the process cartridge to be used is a process cartridge including the electrophotographic photoconductor according to the second exemplary embodiment. The process cartridge may include, in addition to the electrophotographic photoconductor, at least one selected from the group consisting of, for example, the charging unit, the electrostatic latent image forming unit, the developing unit, and the transfer unit.

An example of the image forming apparatus according to the third exemplary embodiment will now be described; however, the image forming apparatus according to the third exemplary embodiment is not limited thereto. The parts shown in the drawings are described, while description of the other parts is omitted.

Figure 8:
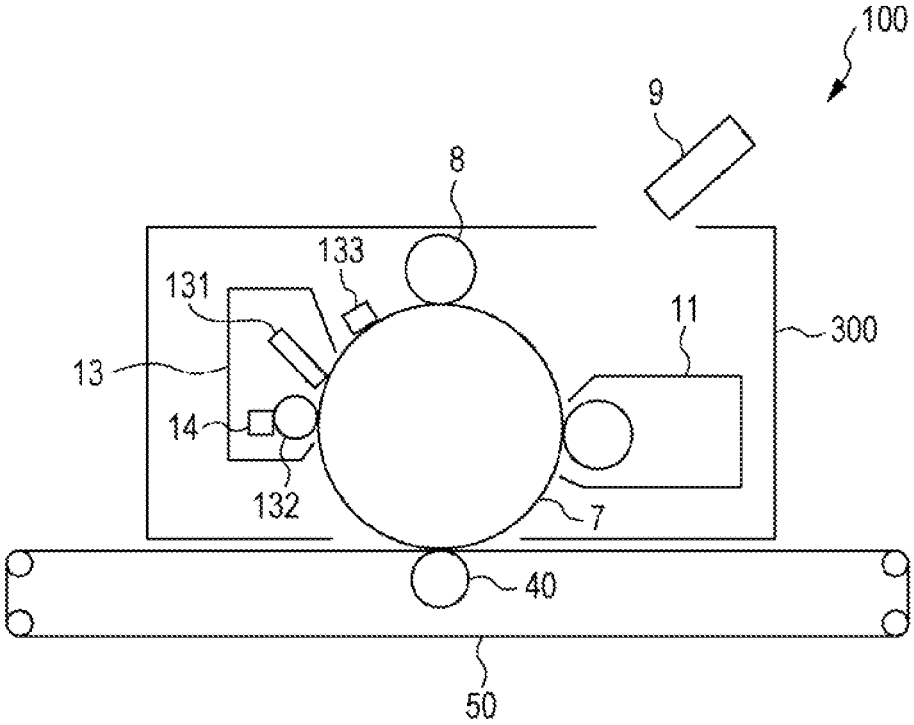
FIG. 8 schematically illustrates an example of the structure of an image forming apparatus according to a third exemplary embodiment.

FIG. 8 schematically illustrates an example of the structure of the image forming apparatus according to the third exemplary embodiment.

As illustrated in FIG. 8, an image forming apparatus 100 according to the third exemplary embodiment includes a process cartridge 300 having an electrophotographic photoconductor 7, an exposure device 9 (example of the electrostatic latent image forming unit), a transfer device 40 (first transfer unit), and an intermediate transfer body 50. In the image forming apparatus 100, the exposure device 9 is disposed such that the electrophotographic photoconductor 7 can be irradiated with light through the opening of the process cartridge 300, the transfer unit 40 is disposed so as to face the electrophotographic photoconductor 7 with the intermediate body 50 interposed therebetween, and the intermediate body 50 is placed such that part thereof is in contact with the electrophotographic photoconductor 7. Although not illustrated, the image forming apparatus also includes a second transfer device that serves to transfer a toner image transferred to the intermediate transfer body 50 to a recording medium (e.g., paper). In this case, the intermediate transfer body 50, the transfer device 40 (first transfer device), and the second transfer device (not illustrated) are an example of the transfer unit.

In the process cartridge 300 illustrated in FIG. 8, a housing integrally accommodates the electrophotographic photoconductor 7, the charging device 8 (example of the charging unit), the developing device 11 (example of the developing unit), and the cleaning device 13 (example of the cleaning unit). The cleaning device 13 has a cleaning blade 131 (example of a cleaning member), and the cleaning blade 131 is disposed so as to be in contact with the surface of the electrophotographic photoconductor 7. The cleaning member does not need to be in the form of the cleaning blade 131 but may be a conductive or insulating fibrous member; this fibrous member may be used alone or in combination with the cleaning blade 131.

The example of the image forming apparatus in FIG. 8 includes a fibrous member 132 (roll) that serves to supply a lubricant 14 to the surface of the electrophotographic photoconductor 7 and a fibrous member 133 (flat brush) that supports the cleaning, and these members are optionally placed.

Each part of the image forming apparatus according to the third exemplary embodiment will now be described.

Charging Device

Examples of the charging device 8 includes contact-type chargers that involve use of a conductive or semi-conductive charging roller, charging brush, charging film, charging rubber blade, or charging tube. Any of other known chargers may be used, such as a non-contact-type roller charger and a scorotron or coroton charger in which corona discharge is utilized.

Exposure Device

Examples of the exposure device 9 include optical systems that expose the surface of the electrophotographic photoconductor 7 to light, such as light emitted from a semiconductor laser, an LED, or a liquid crystal shutter, in the shape of the intended image. The wavelength of light source is within the spectral sensitivity of the electrophotographic photoconductor. The light from a semiconductor laser is generally near-infrared light having an oscillation wavelength near 780 nm. The wavelength of the light is, however, not limited thereto; laser light having an oscillation wavelength of the order of 600 nm or blue laser light having an oscillation wavelength ranging from 400 nm to 450 nm may be employed. A surface-emitting laser source that can emit multiple beams is also effective for formation of color images.

Developing Device

Examples of the developing device 11 is general developing devices that develop images through contact or non-contact with a developer. The developing device 11 is not particularly limited provided that it has the above-mentioned function, and a proper structure for the intended use is selected. An example of the developing device 11 is a known developing device that serves to attach a one-component or two-component developer to the electrophotographic photoconductor 7 with a brush or a roller. In particular, a developing device including a developing roller of which the surface holds a developer is suitable.

The developer used in the developing device 11 may be either of a one-component developer of toner alone and a two-component developer containing toner and a carrier. The developer may be either magnetic or nonmagnetic. Any of known developers may be used.

Cleaning Device

The cleaning device 13 is a cleaning-blade type in which the cleaning blade 131 is used.

The cleaning device 13 may have a structure other than the cleaning-blade type; in particular, fur brush cleaning may be employed, or the cleaning may be performed at the same time as the developing.

Transfer Device

Examples of the transfer device 40 include known transfer chargers such as contact-type transfer chargers having a belt, a roller, a film, or a rubber blade and a non-contact-type transfer chargers in which corona discharge is utilized, e.g., a scorotron transfer charger and a corotron transfer charger.

Intermediate Transfer Body

The intermediate transfer body 50 is, for instance, in the form of a belt (intermediate transfer belt) containing a semi-conductive polyimide, polyamide imide, polycarbonate, polyarylate, polyester, or rubber. The intermediate transfer body may be in the form other than a belt, such as a drum.

Figure 9:
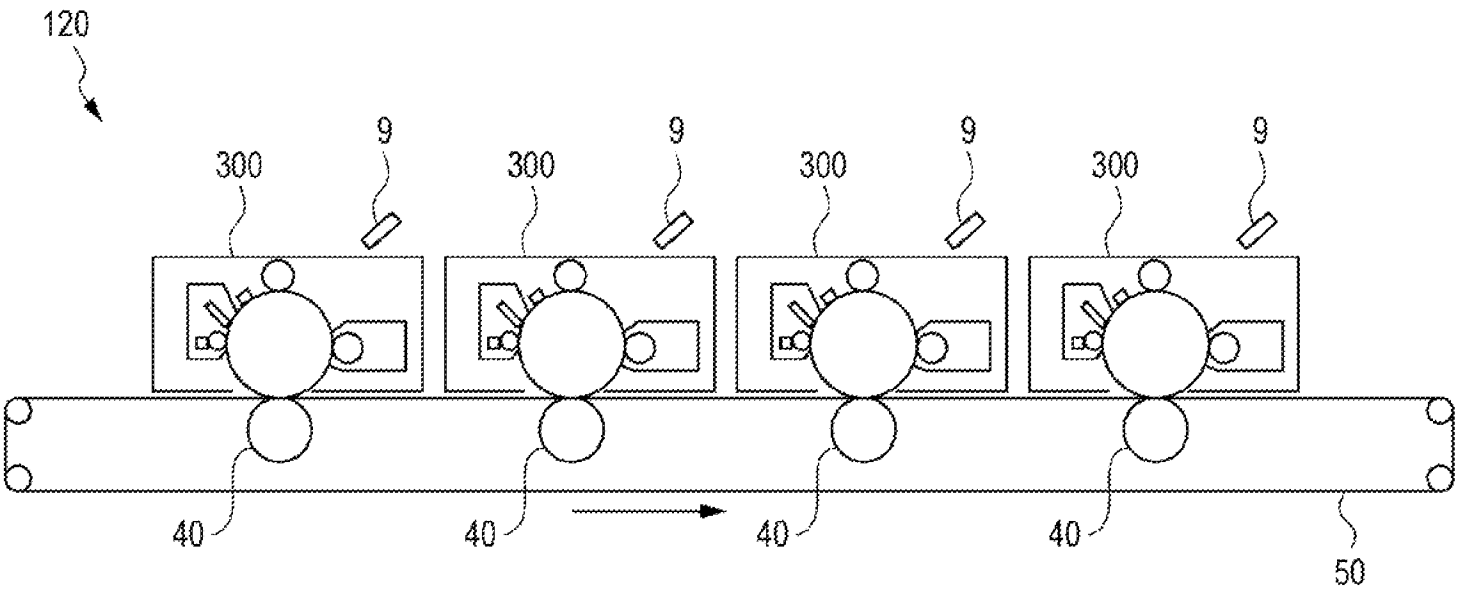
FIG. 9 schematically illustrates another example of the structure of an image forming apparatus according to the third exemplary embodiment.

FIG. 9 schematically illustrates another example of the structure of the image forming apparatus according to the third exemplary embodiment.

An image forming apparatus 120 illustrated in FIG. 9 is a tandem-type multicolor image forming apparatus including four process cartridges 300. In the image forming apparatus 120, the four process cartridges 300 are disposed in parallel so as to overlie the intermediate transfer body 50, and one electrophotographic photoconductor serves for one color. Except that the image forming apparatus 120 is a tandem type, it has the same structure as the image forming apparatus 100.

Examples

The present invention will now be further specifically described with reference to Examples but is not limited thereto. The term "part" will now be on a mass basis unless otherwise specified.

Conductive Substrate A1

Preparing Slug and Applying Lubricant

A slug of an alloy that has an aluminum purity of not less than 99.5 mass % and that is called 1050 alloy in accordance with JIS is prepared.

A lubricant mixture is prepared by mixing 30 parts of a long-chain fatty acid ester (1) having a kinematic viscosity of 11.4 $mm^2/s$ at 100° C. (compound name: trimethylolpropane ester, product name: UNISTER C-3371A manufactured by NOF CORPORATION) and 70 parts of a liquid hydrocarbon polymer (1) having a kinematic viscosity of 4.7 $mm^2/s$ at 100° C. (product name: Polybutene ON manufactured by NOF CORPORATION, number average molecular weight: 370). The lubricant mixture has a kinematic viscosity of 6.0 $mm^2/s$ at 100° C. The lubricant mixture is applied to the slug by dip coating to form the coating film of the lubricant on the surface thereof.

Impact Pressing and Ironing

The slug having the coating film of the lubricant is impact-pressed with a die (female die) and a punch (male die) into a cylindrical body having a bottom. Then, the cylindrical body is ironed to produce a cylindrical aluminum substrate having a diameter of 24 mm, a length of 251 mm, and a thickness of 0.5 mm. The aluminum substrate is subsequently annealed at 220° C. for 60 minutes.

Washing

The annealed aluminum substrate is immersed into a hydrocarbon washing agent (1) (compound name: washing agent of a hydrocarbon having 10 carbon atoms, product name: NS Clean 110 manufactured by Nikko Petrochemical Co., Ltd.) for 30 minutes for soak washing.

The aluminum substrate produced in this manner is a conductive substrate A1.

Conductive Substrate A2

A conductive substrate A2 is produced as in the production of the conductive substrate A1 except that the amount of the long-chain fatty acid ester (1) is changed from 30 parts to 5 parts and that the amount of the liquid hydrocarbon polymer (1) is changed from 70 parts to 95 parts.

Conductive Substrate A3

A conductive substrate A3 is produced as in the production of the conductive substrate A1 except that the amount of the long-chain fatty acid ester (1) is changed from 30 parts to 65 parts and that the amount of the liquid hydrocarbon polymer (1) is changed from 70 parts to 35 parts.

Conductive Substrate A4

A conductive substrate A4 is produced as in the production of the conductive substrate A1 except that 30 parts of a long-chain fatty acid ester (2) (product name: UNISTER HR-32 manufactured by NOF CORPORATION) is used in place of the 30 parts of the long-chain fatty acid ester (1) and that 70 parts of a liquid hydrocarbon polymer (2) (product name: Polybutene 015N manufactured by NOF CORPORATION, number average molecular weight: 580) is used in place of the 70 parts of the liquid hydrocarbon polymer (1).

Conductive Substrate A5

A conductive substrate A5 is produced as in the production of the conductive substrate A4 except that the amount of the long-chain fatty acid ester (2) is changed from 30 parts to 5 parts and that the amount of the liquid hydrocarbon polymer (2) is changed from 70 parts to 95 parts.

Conductive Substrate A6

A conductive substrate A6 is produced as in the production of the conductive substrate A4 except that the amount of the long-chain fatty acid ester (2) is changed from 30 parts to 65 parts and that the amount of the liquid hydrocarbon polymer (2) is changed from 70 parts to 35 parts.

Conductive Substrate A7

A conductive substrate A7 is produced as in the production of the conductive substrate A1 except that 2 parts of a long-chain fatty acid ester (3) (product name: UNISTER C400B manufactured by NOF CORPORATION) is used in place of the 30 parts of the long-chain fatty acid ester (1) and that the amount of the liquid hydrocarbon polymer (1) is changed from 70 parts to 98 parts.

Conductive Substrate A8

A conductive substrate A8 is produced as in the production of the conductive substrate A7 except that the amount of the long-chain fatty acid ester (3) is changed from 2 parts to 10 parts and that the amount of the liquid hydrocarbon polymer (1) is changed from 98 parts to 90 parts.

Conductive Substrate A9

A conductive substrate A9 is produced as in the production of the conductive substrate A7 except that the amount of the long-chain fatty acid ester (3) is changed from 2 parts to 30 parts and that the amount of the liquid hydrocarbon polymer (1) is changed from 98 parts to 70 parts.

Comparative Conductive Substrate B1

A comparative conductive substrate B1 is produced as in the production of the conductive substrate A1 except that zinc stearate is used in place of the lubricant mixture of the 30 parts of the long-chain fatty acid ester (1) and the 70 parts of the liquid hydrocarbon polymer (1).

Comparative Conductive Substrate B2

A comparative conductive substrate B2 is produced as in the production of the comparative conductive substrate B1 except that zinc laurate is used in place of zinc stearate.

Comparative Conductive Substrate B3

A comparative conductive substrate B3 is produced as in the production of the comparative conductive substrate B1 except that barium linoleate is used in place of zinc stearate.

Examples and Comparative Examples

Each of the conductive substrates A1 to A9 and the comparative conductive substrates B1 to B3 is subjected to formation of an undercoat layer, a charge-generating layer, and a charge-transporting layer in the manner described below to produce an electrophotographic photoconductor.

Formation of Undercoat Layer

Under stirring, 100 parts of zinc oxide (average particle size: 70 nm, manufactured by TAYCA CORPORATION, specific surface area: 15 $m^2/g$) and 500 parts of tetrahydrofuran are mixed with each other. Then, 1.3 parts of a silane coupling agent (KBM 503 manufactured by Shin-Etsu Chemical Co., Ltd.) is added thereto, and the resulting mixture is stirred for 2 hours. Toluene contained therein is removed by vacuum distillation, and the resulting product is baked at 120° C. for 3 hours, thereby producing zinc oxide that has been subjected to surface treatment with the silane coupling agent.

Under stirring, 110 parts of the surface-treated zinc oxide and 500 parts of tetrahydrofuran are mixed with each other. A solution in which 0.6 parts of alizarin has been dissolved in 50 parts of tetrahydrofuran is added thereto, and the resulting mixture is stirred at 50° C. for 5 hours. Then, the zinc oxide to which alizarin has been added is separated by filtration under reduced pressure and then dried at 60° C. under reduced pressure to obtain an alizarin-added zinc oxide.

Then, 60 parts of the alizarin-added zinc oxide, 13.5 parts of a curing agent (blocked isocyanate, Sumidur 3175 manufactured by Sumitomo Bayer Urethane Co., Ltd.), and 15 parts of a butyral resin (S-LEC BM-1 manufactured by SEKISUI CHEMICAL CO., LTD.) are dissolved in 85 parts of methyl ethyl ketone; and 38 parts of this solution and 25 parts of methyl ethyl ketone are mixed with each other. The mixture is subjected to dispersion for 2 hours in a sand mill using glass beads having a diameter of 1 mm to obtain a dispersion liquid.

To the dispersion liquid, 0.005 parts of dioctyltin dilaurate as a catalyst and 45 parts of silicone resin particles (Tospearl 145 manufactured by Momentive Performance Materials Inc.) are added to produce a coating liquid used for forming an undercoat layer. The coating liquid used for forming an undercoat layer is applied onto each of the conductive substrates by dip coating and then dried at 170° C. for 30 minutes for curing to form an undercoat layer having a thickness of 23 μm.

Formation of Charge-Generating Layer

Then, 1 part of hydroxygallium phthalocyanine having strong diffraction peaks at Bragg angles (20±0.2°) of 7.5°, 9.9°, 12.5°, 16.3°, 18.6°, 25.1°, and 28.3° in an X-ray diffraction spectrum is mixed with 1 part of polyvinyl butyral (S-LEC BM-S manufactured by SEKISUI CHEMICAL CO., LTD.) and 80 parts of n-butyl acetate; and this mixture is subjected to a dispersion treatment with a paint shaker using glass beads for 1 hour to prepare a coating liquid used for forming a charge-generating layer. The coating liquid used for forming a charge-generating layer is applied onto the undercoat layer by dip coating and heated at 100° C. for 10 minutes for drying to form a charge-generating layer having a thickness of 0.15 μm.

Formation of Charge-Transporting Layer

In 25 parts of tetrahydrofuran (THF), 2.6 parts of a benzidine compound represented by Formula (CT-1) and 3 parts of a polymeric compound represented by Formula (B-1) and having a repeating unit (viscosity average molecular weight: 40,000) are dissolved to prepare a coating liquid used for forming a charge-transporting layer. The coating liquid used for forming a charge-transporting layer is applied to the charge-generating layer by dip coating and heated at 130° C. for 45 minutes for drying to form a charge-transporting layer having a thickness of 20 μm.

Through these processes, an electrophotographic photoconductor is produced.

(CT-1)

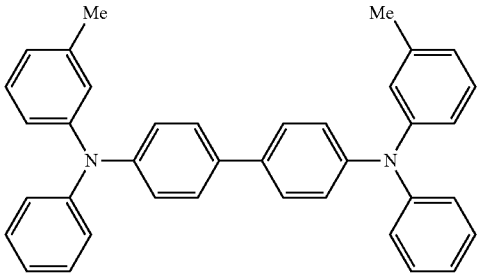

(B-1)

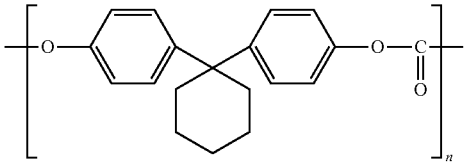

Evaluation

Residual Amount of Lubricant

The residual amount (mg/cm$^2$) of the lubricant (long-chain fatty acid ester based lubricant or another lubricant) on the outer surface of each of the conductive substrates produced in Examples and Comparative Examples is measured in the above-mentioned manner. Tables 1 and 2 show results of the measurement.

Occurrence of Damage

The outer surface of each of the conductive substrates produced in Examples and Comparative Examples is visually observed in order to find damage caused by the impact pressing.

Found: Damage is found though visual observation

None: No damage is found through visual observation

Uneven Application of Coating Liquid and Coating Liquid Repellency

In the above-mentioned application of the coating liquid used for forming the undercoat layer, each of the conductive substrates produced in Examples and Comparative Examples is observed in order to find uneven application thereof (phenomenon in which the applied coating liquid partially has a different thickness) and coating liquid repellency (phenomenon in which the coating liquid is not successfully applied to part of the conductive substrate).

None: No coating liquid repellency and no uneven application are found

Found: Both of coating liquid repellency and uneven application are found

TABLE 1

| | Conductive substrate | Lubricant (a) | Viscosity modifier (b) | Ratio (a)/(b) [mass ratio] | Washing agent | Residual amount of lubricant (a) on surface [mg/cm$^2$] | Damage | Coating liquid repellency and uneven application |
|---|---|---|---|---|---|---|---|---|
| Example 1 | A1 | Long-chain fatty acid ester (1) | Liquid hydrocarbon polymer (1) | 30/70 | Hydrocarbon based washing agent (1) | 0 | None | None |
| Example 2 | A2 | Long-chain fatty acid ester (1) | Liquid hydrocarbon polymer (1) | 5/95 | Hydrocarbon based washing agent (1) | 0 | None | None |
| Example 3 | A3 | Long-chain fatty acid ester (1) | Liquid hydrocarbon polymer (1) | 65/35 | Hydrocarbon based washing agent (1) | 0 | None | None |
| Example 4 | A4 | Long-chain fatty acid ester (2) | Liquid hydrocarbon polymer (2) | 30/70 | Hydrocarbon based washing agent (1) | 0 | None | None |
| Example 5 | A5 | Long-chain fatty acid ester (2) | Liquid hydrocarbon polymer (2) | 5/95 | Hydrocarbon based washing agent (1) | 0 | None | None |
| Example 6 | A6 | Long-chain fatty acid ester (2) | Liquid hydrocarbon polymer (2) | 65/35 | Hydrocarbon based washing agent (1) | 0 | None | None |
| Example 7 | A7 | Long-chain fatty acid ester (3) | Liquid hydrocarbon polymer (1) | 2/98 | Hydrocarbon based washing agent (1) | 0 | None | None |
| Example 8 | A8 | Long-chain fatty acid ester (3) | Liquid hydrocarbon polymer (1) | 10/90 | Hydrocarbon based washing agent (1) | 0 | None | None |
| Example 9 | A9 | Long-chain fatty acid ester (3) | Liquid hydrocarbon polymer (1) | 30/70 | Hydrocarbon based washing agent (1) | 0 | None | None |

TABLE 2

| | Conductive substrate | Lubricant (a) | Viscosity modifier (b) | Ratio (a)/(b) [mass ratio] | Washing agent | Residual amount of lubricant (a) on surface [mg/cm$^2$] | Damage | Coating liquid repellency and uneven application |
|---|---|---|---|---|---|---|---|---|
| Comparative Example 1 | Comparative B1 | Zinc stearate | — | 100/0 | Hydrocarbon based washing agent (1) | $6.9 \times 10^3$ | Found | Found |
| Comparative Example 2 | Comparative B2 | Zinc laurate | — | 100/0 | Hydrocarbon based washing agent (1) | $9.5 \times 10^3$ | Found | Found |
| Comparative Example 3 | Comparative B3 | Barium linoleate | — | 100/0 | Hydrocarbon based washing agent (1) | $7.4 \times 10^3$ | Found | Found |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoconductor comprising:

a cylindrical member comprising:

an impact-pressed cylindrical body containing aluminum; and a long-chain fatty acid ester based lubricant that is present on the outer surface of the impact-pressed cylindrical body, the long-chain fatty acid ester based lubricant being in an amount of more than $5.0\times10^{-4}$ mg/cm$^2$ and not more than $5.0\times10^{-3}$ mg/cm$^2$; and a photoconductive layer disposed so as to overlie the cylindrical member.

2. A process cartridge comprising:

the electrophotographic photoconductor according to claim 1, wherein the process cartridge is removably attached to an image forming apparatus.

3. An image forming apparatus comprising:

the electrophotographic photoconductor according to claim 1;

a charging unit that serves to charge the surface of the electrophotographic photoconductor;

an electrostatic latent image forming unit that serves to form an electrostatic latent image on the surface of the charged electrophotographic photoconductor;

a developing unit that serves to develop the electrostatic latent image on the surface of the electrophotographic photoconductor with a developer containing toner to form a toner image; and a transfer unit that serves to transfer the toner image to the surface of a recording medium.

* * * * *